United States Patent [19]

Burch

[11] 4,270,736

[45] Jun. 2, 1981

[54] CLIMB INHIBITING RAIL

[76] Inventor: Fred O. Burch, 3024 Avenue N, Plano, Tex. 75074

[21] Appl. No.: 75,942

[22] Filed: Sep. 17, 1979

[51] Int. Cl.[3] ..... E04H 17/00

[52] U.S. Cl. ..... 256/12; 256/16

[58] Field of Search ..... 256/11, 12, 16, 1

[56] References Cited

U.S. PATENT DOCUMENTS

| | | | |
|---|---|---|---|
| 321,171 | 6/1885 | Archibald | 256/12 |
| 470,556 | 3/1892 | Dunning | 256/16 |
| 511,700 | 12/1893 | Jacobs | 308/205 X |
| 511,701 | 12/1893 | Jacobs | 256/12 |
| 833,108 | 10/1906 | Avent | 256/16 |
| 895,548 | 8/1908 | Flewellin et al. | 256/16 |
| 1,140,171 | 5/1915 | Lawrie et al. | 256/16 |
| 3,861,084 | 1/1975 | Ford | 256/12 X |
| 4,065,103 | 12/1977 | Sweezey | 256/11 |

FOREIGN PATENT DOCUMENTS 612265 11/1948 United Kingdom .

*Primary Examiner*—Andrew V. Kundrat
*Attorney, Agent, or Firm*—Warren H. Kintzinger; Dennis T. Griggs

[57] ABSTRACT

A climb inhibiting structure for integration with, or attachment to, a fence run incorporating a longitudinally extending rod-like bearing member that is mounted in parallel-displaced relationship with the top extreme of the fence run. A series of relatively short turn cylinders are rotatably mounted, end-to-end, about the bearing member. A plurality of spine-like members extend radially outwardly from the surface of each rotatable member in spaced relationship precluding purchase by an animal's leg or paw. The spines are preferably yieldable so as to substantially minimize injury to climber, with rotation of the spine carrying member precluding a purchase by means of which the climber might pull itself up and over the fence.

1 Claim, 4 Drawing Figures

CLIMB INHIBITING RAIL

BACKGROUND OF THE INVENTION

1. Field of the Invention

This invention relates in general to confinement enclosures for pets, and in particular to an anti-climb device for addition to, or integration with, a fence enclosure.

2. Description of the Prior Art

Anti-climb devices for fences are known which, for example, provide an extension from the top fence rail which is angled either inwardly or outwardly from the plane of the fence, generally angled outwardly from that face of the fence from which climbing is to be inhibited. If the fence is primarily to inhibit climbing into the fence defined confines, the upper angled portion extends from the outside of the fence face, and, if confinement within is the primary fence purpose, the extension extends from the inside fence face.

A popular form of climb inhibiting devices is barbed wire strung in parallel runs and attached to angled brackets extended from fence posts. While these means are effective, they nonetheless offer unsightly protection, must be tensioned periodically to prevent sagging, and suffer in effectiveness in providing a more or less rigid means which can provide a hand or leg-hold purchase for the determined climber. Additionally, the barbed wire runs may cause severe injury to a small child or pet.

SUMMARY OF OBJECTS OF THE INVENTION

It is, therefore, a principal object of this invention to provide a fence climbing inhibition means which may be added to, or otherwise integrated with, a line fence structure, and which provides no rigid means for hand or foot hold purchase by climber.

Another object of the invention is the provision of an effective fence climbing inhibitor means which substantially precludes injury to the climber, as opposed to barbed wire runs, for example.

A still further object of the invention is the provision of a climb inhibiting means which may be simply and economically added by attachment to an existing fence, whether it be of chain-link, board, picket, or other structural type.

Another object of the present invention is the provision of a fence climbing inhibitor structure which does not materially detract from the architectural aesthetics of a fence run.

Yet another object is the provision of a climbing inhibitor which requires only minimum maintenance.

SUMMARY OF THE INVENTION

Features of this invention useful in accomplishing the above objects include, in a climbing inhibitor means for a fence structure, a cylindrical rail-like means mounted in offset-paralleled relationship to the upper exteme of a fence row so as to be spaced from the plane of the fence, preferably on that side of the fence from which climbing is to be inhibited. The rail-like means is mounted for rotation about its longitudinal axis and with respect to the fence structure per se, and is coextensive with the fence run. A plurality of resilient spike-like members, extending radially outwardly from the surface of the rotatable cylindrical rail-like means, are dispersed in a selected pattern, or in random fashion, along the extent of the rail-like means, with spacing between spike members being generally less than which would accommodate the limb (such as arm, paw, leg, hand, etc.) of a would-be climber.

A specific embodiment representing that presently regarded as the best mode of carrying out the invention is illustrated in the accompanying drawing.

DETAILED DESCRIPTION OF THE PREFERRED EMBODIMENTS

The fence climbing inhibitor means to be described has, as a contemplated primary purpose, the prevention of fence climbing by jumping and climbing animals such as dogs, and is particularly effective in preventing dogs from climbing over relatively low fences which dogs may not be able to leap over but, nonetheless, can leap or climb to an extent where front paws may obtain a purchase on the fence top rail or fence top extreme, whereupon the animal may pull itself up and over the top of the fence.

While it is desired to prevent such a pet from climbing and escaping from its enclosure, it is equally important that a device which inhibits such action does not present an injury hazard to the pet. Small children also climb fences, and a climb inhibitor should not present an injury hazard to the child. Still further, it is desired that fence enclosures have aesthetic as well as protective utilitarian features, and that climb inhibiting means be economical and readily attachable to the fence. The fence climbing inhibitor means to be described uniquely addresses all of the above considerations.

Figure 1:
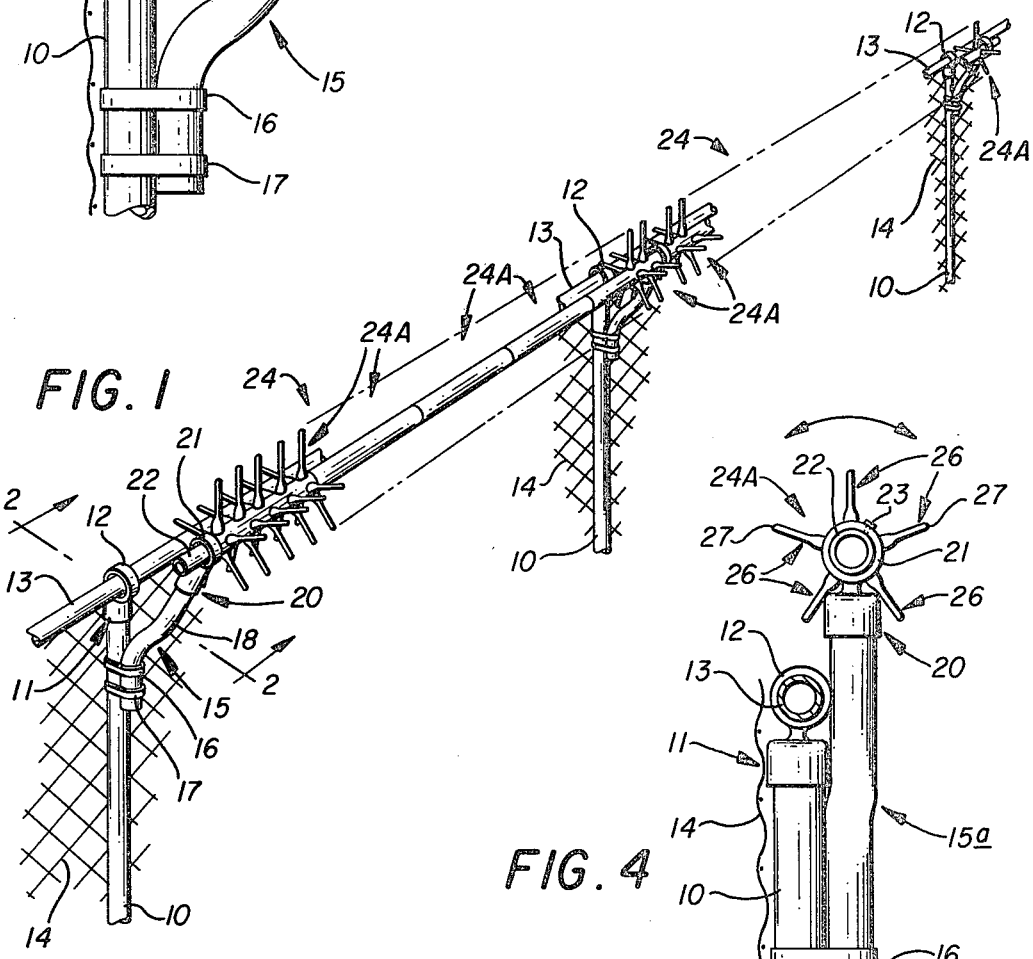
FIG. 1 represents a perspective view of a chain-like fence run equipped with the climbing inhibitor means of the present invention.

FIG. 1 illustrates a fence run of the well-known chain-link type comprising spaced steel posts 10 each fitted with a post cap member 11 which fits over the top of post 10 and includes a ring member 12 through which the fence top railing 13 is received for mounting. The fence is completed by chain link mesh 14 which is attached to the post and top rail structure by wire ties (not shown).

Figure 2:
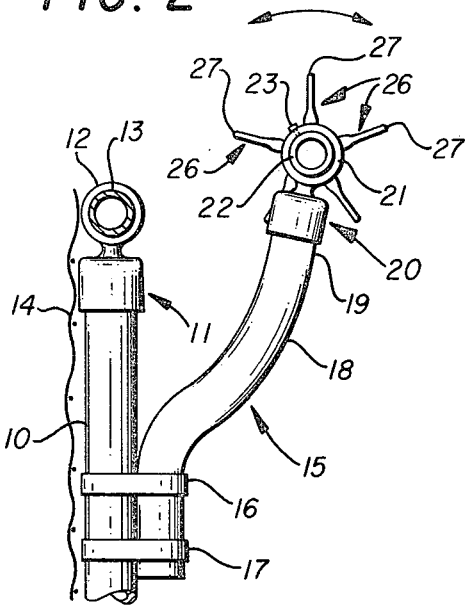
FIG. 2 is a sectional view of the fence run with inhibitor structure taken along line 2—2 of FIG. 1.
Figure 3:
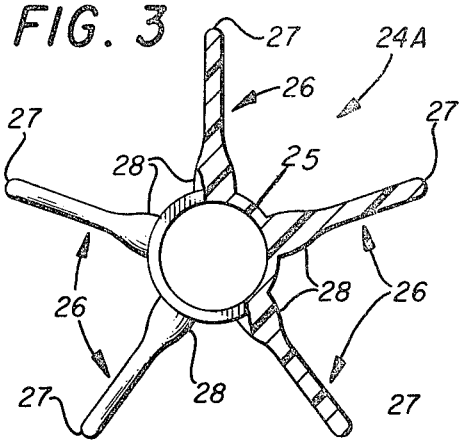
FIG. 3 is a partially sectioned end-view of the spike-carrying rotatable members as embodied in FIGS. 1 and 2; and, FIG. 4 is an alternate mounting means for the climb inhibitor structure of the invention.

The chain-link fence run of FIG. 1 is shown fitted with a climb inhibiting structure in accordance with the present invention. Each post 10 of the fence structure carries an angled mounting bracket 15 affixed to the post by means of clamping straps 17. Body member 18 of the bracket 15 comprises a short length of tubing which may be a length of fence post 10 material. Bracket body member 18 is shown in FIG. 1 as being angled outwardly from the viewed side of the fence run, with the upper end 19 of the body member 18 fitted with a cap member 20 like that of fence post caps 11, including a ring member 21 through which a length of tubing 22, like that of fence top rail 13, is receivable. As best shown in FIG. 2, tubing 22 may be selectively anchored to ring 21 of cap member 20 by means of a set screw 23. The structure thus far described is seen to provide an offset top rail run composed of the length of tubing 22 which is carried in parallel offset relationship to the fence run top rail 13. As best shown in FIGS. 2 and 3, the tubing run 22 is displaced inwardly from the viewed face of the fence of FIG. 1 and slightly higher than the fence top rail 13.

The climb inhibiting feature, as shown in FIGS. 1–4, comprises a further tubular assembly 24 which is slideably receivable over the offset tubing run 22 and of inside diameter permitting free relative rotation between assembly 24 and the tubing run 22. Preferably, the tubular assembly 24 comprises a series of relatively short turn cylinders 24A which are disposed in end-to-end relation between adjacent posts 10. For post spacing of ten feet, the turn cylinders are each preferably one foot in length and are capable of turning independently of each other between the adjacent pairs of posts. By keeping the length of the turn cylinders relatively short as compared with the length of the tubing 22, frictional forces and binding caused by sagging of the tubing run 22 will be minimized, thereby assuring easy rotation, and preventing climbing purchase.

The turn cylinders 24A, as best shown in FIG. 3, each comprise a hollow central cylindrical core 25 from which a plurality of radially extending spike or spine members 26 extend. Spine members 26 preferably are formed with blunted tips 27 and enlarged base portion 28 for structural integrity, similar in shape to a golf tee. For meeting the stated objections of the invention, spine members 26 preferably comprise a flexible, yieldable material such as plastic which readily flexes and has sufficient resiliency to reassume the illustrated outward projection when released. As shown in FIG. 3, the turn cylinder 24A, including spine projections 26, comprise an integrally molded plastic structure. In a preferred arrangement, the plastic spined tubular structure 24A is formed in convenient one foot lengths which are readily slipped over runs of offset tubing run 22, with facing ends of adjacent lengths bearing on one another, and outside ends of those lengths terminating a run between adjacent mounting caps 20, bearing on the ring members 21 of those caps.

Figure 4:
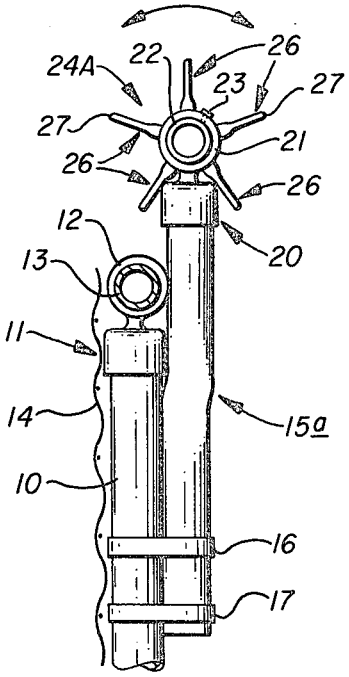

FIG. 4 shows an alternative mounting bracket arrangement as concerns the climbing inhibitor structure, wherein bracket arm 15*a* may comprise straight lengths of tubing 18 of the same material as fence posts 10, with the tubing 18 again providing a selected height mounting for the offset rail 22 which carries the spined member 24A, with a lesser offset than that provided by the angled brackets 15 of FIGS. 1 and 2.

In operation, referring to FIG. 1, a dog, for example, attempting to climb the fence from the viewed side (the offset side as concerns spined assembly 24) by gaining a fore-leg purchase on the top of the fence run, is presented with the spines 26, so spaced that the dog's paw must engage a spine end (or ends) 27. As engagement is made, the turn cylinders 24A rotate to drop the animal back to the ground, i.e., no purchase can be effectively made by means of which the animal can pull itself over the top of the fence. Any such purchase made has an effective further deterent of the animal's under-belly engaging the spine ends, which, as previously described, presents extreme discomfort, but without injury. Upon the animal being so persuaded to release any purchase it may have gained the spined structure rotates to drop the animal back inside the fence.

Whereas this invention is herein illustrated and described with respect to particular embodiments thereof, it should be realized that various changes may be made without departing from essential contributions to the art made by the teachings hereof.

What is claimed is:

1. A climbing inhibitor assembly for a fence structure of the type having a top rail member (13) supported between a pair of upstanding, laterally spaced posts (10), said climbing inhibitor assembly comprising:

a tubular bearing member (22) mountable on adjacent fence posts (10) in offset-parallel relation to the top rail member (13) of said fence structure;

a series of turn cylinders (24A) mounted for rotation on said tubular bearing member (22), said turn cylinders (24A) being disposed in end-to-end relation, the length of each turn cylinder (24A) being relatively short as compared with the length of the tubular bearing member 22 whereby frictional forces and binding caused by curvature or sagging of the tubular bearing member (10) will be minimized; and, a plurality of separate spine-like members (26) integrally molded with and extending radially outwardly the surface of each turn cylinder (24A), said spine-like members (26) each comprising a yieldable material having a relatively short enlarged base portion for structural integrity and a relatively long, narrow, flexible portion having a relatively rounded tip (27) for causing discomfort but avoiding injury to the limb of a climber engaged with said spine-like members (26).

* * * * *